US007909651B2

(12) United States Patent
Kim et al.

(10) Patent No.: US 7,909,651 B2
(45) Date of Patent: Mar. 22, 2011

(54) MULTIFUNCTIONAL CONNECTION CORD FOR MULTIMEDIA DEVICE

(75) Inventors: Jin-Seok Kim, Seoul (KR); Han-Ho Maeng, Seoul (KR); Young-Woong Han, Seoul (KR); Myung-Hoon Jung, Gyeonggi-do (KR)

(73) Assignee: Yungs Group, Inc., Yoksam-dong, Kangnam-gu, Seoul (KR)

( * ) Notice: Subject to any disclaimer, the term of this patent is extended or adjusted under 35 U.S.C. 154(b) by 97 days.

(21) Appl. No.: 12/054,458

(22) Filed: Mar. 25, 2008

(65) Prior Publication Data

US 2008/0236866 A1 Oct. 2, 2008

(30) Foreign Application Priority Data

Mar. 31, 2007 (KR) ..... 10-2007-0032124

(51) Int. Cl.
*H01R 25/00* (2006.01)

(52) U.S. Cl. ..... 439/638; 439/660; 439/653

(58) Field of Classification Search ..... 439/607.01, 439/607.17, 607.19, 607.35, 607.36, 607.67, 439/95, 638, 639, 653, 660
See application file for complete search history.

(56) References Cited

U.S. PATENT DOCUMENTS

| | | | | |
|---|---|---|---|---|
| 5,573,425 | A * | 11/1996 | Morisawa et al. | 439/502 |
| 5,775,939 | A * | 7/1998 | Brown | 439/502 |
| 6,203,344 | B1 * | 3/2001 | Ito | 439/218 |
| 6,616,487 | B1 * | 9/2003 | Lai | 439/668 |
| 7,056,127 | B2 * | 6/2006 | Suzuki et al. | 439/39 |
| 7,354,315 | B2 * | 4/2008 | Goetz et al. | 439/669 |
| 2001/0023141 | A1 * | 9/2001 | Chang | 439/76.1 |
| 2007/0197100 | A1 * | 8/2007 | Tsao | 439/638 |
| 2007/0254510 | A1 * | 11/2007 | DeBey | 439/188 |

FOREIGN PATENT DOCUMENTS

| | | |
|---|---|---|
| JP | 2000-357565 | 12/2000 |
| JP | 3079193 | 5/2001 |
| JP | 3081194 | 8/2001 |
| JP | 2002-232986 | 8/2002 |
| JP | 2003-248534 | 9/2003 |
| JP | 2003-282205 | 10/2003 |

(Continued)

OTHER PUBLICATIONS

MIYAVIX, A cradle for an iPod Nano provided with a remote control~, Impress Watch Co., Ltd, Japan, Nov. 18, 2005, http://av.watch.impress.co.jp/docs/20051118/miyavix.htm.

"DIATEC is making available for sale a short cable for an iPod, which is easy to handle" , Japan, ITmedia Co., Ltd, Apr. 3, 2006, http://plusd.itmedia.co.jp/lifestyle/articles/0604/03/news080.html.

(Continued)

*Primary Examiner* — Tho D Ta
*Assistant Examiner* — Travis Chambers
(74) *Attorney, Agent, or Firm* — Lexyoume IP Group, PLLC.

(57) ABSTRACT

A multifunctional connection cord having data and power interfaces for a personal computer and audio interface for an earphone is provided. A multifunctional connection cord of the present invention includes a stem; an audio plug mounted to protrude from one side of the stem for establishing audio signal lines with a multimedia device; a data/power connector mounted near the audio plug to protrude from the stem for establishing data lines and power charge lines with an external device; a USB connector electrically connected to the audio plug and the data/power connector through a cable by means of the stem; and a socket holder mounted on one side of the USB connector and having an audio socket for receiving an audio plug.

12 Claims, 14 Drawing Sheets

FOREIGN PATENT DOCUMENTS

| | | |
|---|---|---|
| JP | 2005-093366 | 4/2005 |
| JP | 2005-267533 | 9/2005 |
| JP | 3120915 | 3/2006 |
| JP | 2006-196977 | 7/2006 |
| KR | 1020010059527 | 7/2001 |
| KR | 1020010067408 | 7/2001 |
| KR | 1020050014251 | 2/2005 |
| KR | 1020060116207 | 11/2006 |
| KR | 1020060120303 | 11/2006 |

OTHER PUBLICATIONS

"ELECOM adds a "Black Type" to a reel-type USB cable for connection to an iPod", Japan, ITmedia Co., Ltd, Nov. 22, http://plusd.itmedia.co.jp/lifestyle/articles/0511/22/news087.html.

Pod-On ! REMOTE for iPaid nano, JAPAN, Miyavic Ltd., Oct. 14, 2010, http://www.miyavix.co.jp/Product/miyavix/podon_nano/index.html.

* cited by examiner

MULTIFUNCTIONAL CONNECTION CORD FOR MULTIMEDIA DEVICE

CROSS-REFERENCE TO RELATED APPLICATION

This application claims priority to and the benefit of Korean Patent Application No. 10-2007-0032124 filed in the Korean Intellectual Property Office on Mar. 31, 2007, the entire contents of which are incorporated herein by reference.

BACKGROUND OF THE INVENTION

1. Field of the Invention

The present invention relates to a connection cord for a multimedia device and, in particular, to a multifunctional connection cord providing audio, data, and power interfaces.

2. Description of the Related Art

With the advances of sound enhancement and communication technologies, various portable multimedia devices, such as an MP3 player, a portable multimedia player (PMP), a digital camera, and a mobile phone are being widely used.

Typically, such a portable multimedia device is provided with a universal serial bus (USB) port or dock connection port for data and power connection to a personal computer (PC), and an audio jack for outputting audio signals to a headphone or earphone.

However, a somewhat long trip with the portable multimedia device requires carrying the power and data cables as well as the earphone. In order to solve this inconvenience problem, an earphone integrated with a USB connection cord has been proposed by the same applicant. In this case, however, the user has no option to select an earphone having an audio connector other than the USB connector.

In the meantime, as connection profiles become one of the key factors in selecting a portable multimedia device, a user would select an earphone that supports user preferable connection profiles.

Therefore, there has been a need for a multifunctional means that provides data exchange, power charge, and audio output interfaces, simultaneously.

SUMMARY OF THE INVENTION

The present invention has been made in an effort to solve the above problems, and it is an object of the present invention to provide a multifunctional connection cord that is capable of providing audio, data, and power connection interfaces by means of a data/power connector and USB connector.

In accordance with an aspect of the preset invention, a multifunction connection cord includes a stem; an audio plug mounted to protrude from one side of the stem for establishing audio signal lines with a multimedia device; a data/power connector mounted near the audio plug to protrude from the stem for establishing data lines and power charge lines with an external device; a USB connector electrically connected to the audio plug and the data/power connector through a cable by means of the stem; and a socket holder mounted on one side of the USB connector and having an audio socket for receiving an audio plug.

Preferably, the audio plug includes three contact terminals that are electrically connected to corresponding contact terminals of the audio socket for establishing audio lines; and the data/power connector includes a positive power pin, a positive data pin, a negative data pin, and a negative power pin that are electrically connected to a corresponding positive power pin, positive data pin, negative data pin, and negative power pin of the USB connector.

Preferably, the USB connector further includes a detachable cap for covering the USB plug.

In accordance with another aspect of the present invention, a multifunctional connector cord includes a stem; an audio plug mounted to protrude from one side of the stem for establishing audio signal lines with a multimedia device; a data/power connector mounted near the audio plug to protrude from the stem for establishing data lines and power charge lines with an external device; a USB connector electrically connected to the audio plug and the data/power connector through a cable by means of the stem; and a detachable socket holder having a USB socket formed at one end for electrically connecting a detachable socket to the USB connector and an audio socket formed at the other end for receiving an audio plug.

Preferably, the USB socket includes three contact pins that are connected to corresponding terminals of the audio socket through respective wires.

Preferably, the audio plug includes three contact terminals that are electrically connected to a negative power pin, a positive data pin, and a negative data pin of the USB connector through the cable; and the data/power connector includes a negative power pin, a positive data pin, a negative data pin, and a positive power pin that are electrically connected to the negative power pin and the positive data pin of the USB connector.

In accordance with another aspect of the present invention, a multifunctional connection cord includes a stem; an audio plug mounted to protrude from one side of the stem for establishing audio signal lines with a multimedia device; a USB connector electrically connected to the audio plug and the data/power connector through a cable by means of the stem; and a socket holder mounted on one side of the USB connector and having an audio socket for receiving an audio plug.

Preferably, the audio plug includes four contact terminals of which a first, a second, and a third terminals are electrically connected to a negative power pin, a positive data pin, and a negative data pin of the USB connector for establishing audio lines, and a fourth terminal connected to the positive power pin for establishing data input/output lines with the multimedia device via the audio plug.

Preferably, the USB connector further includes a detachable cap for covering the USB plug.

In accordance with another aspect of the present invention, a multifunctional connection cord includes a stem; a data/power connector mounted to protrude from one side of the stem for establishing data lines and power charge lines with an external device via a dock; a USB connector electrically connected to the audio plug and the data/power connector through a cable by means of the stem; and a socket holder mounted on one side of the USB connector and having an audio socket for receiving an audio plug.

Preferably, the data/power connector includes a negative power pin, a positive data pin, a negative data pin, and a positive power pin that are electrically connected to a negative power pin, a positive data pin, a negative data pin, and a positive power pin of the USB connector.

Preferably, the USB connector further includes a detachable cap for covering the USB plug.

BRIEF DESCRIPTION OF THE DRAWINGS

The above and other objects, features, and advantages of the present invention will be more apparent from the following detailed description in conjunction with the accompanying drawings, in which.

DETAILED DESCRIPTION OF EXEMPLARY EMBODIMENTS

Figure 1A:
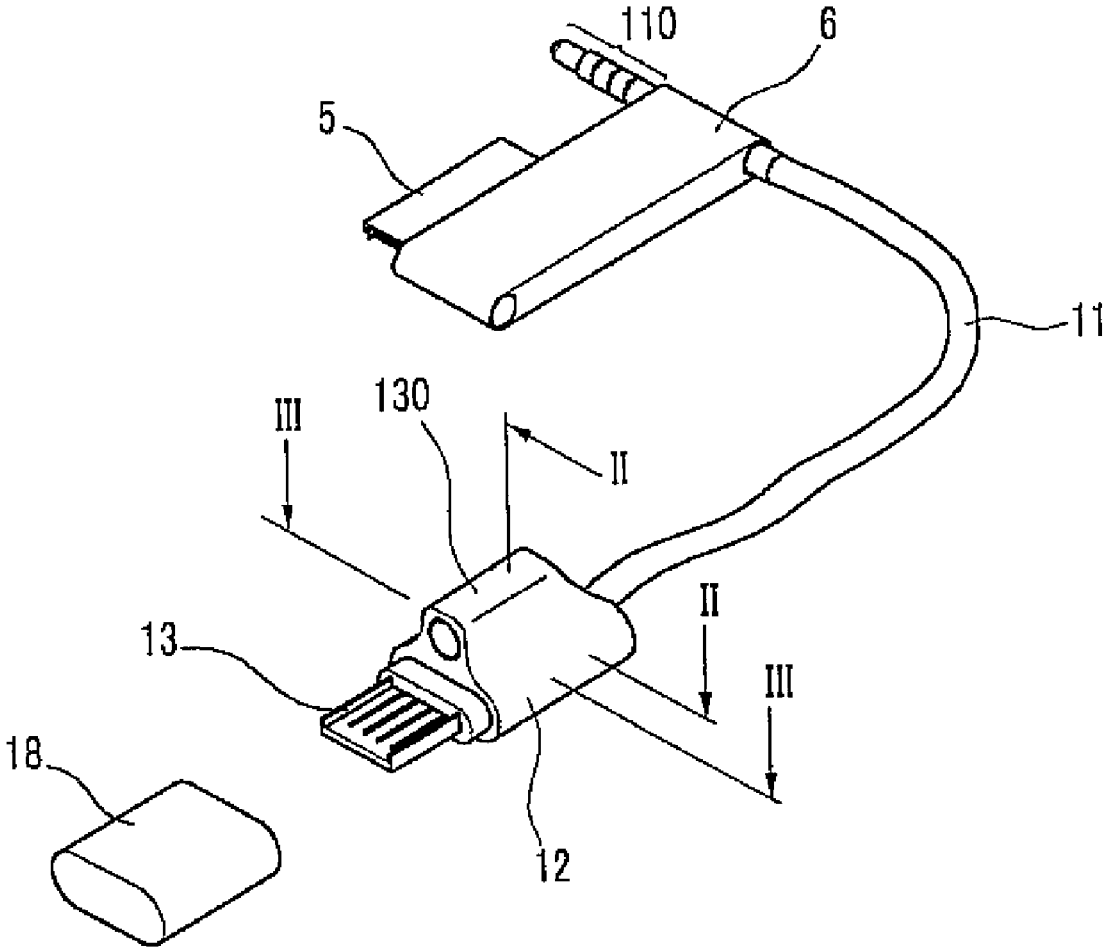
FIGS. 1A to 1D are drawings illustrating a configuration of a multifunctional connection cord according to an exemplary embodiment of the present invention.
Figure 1B:
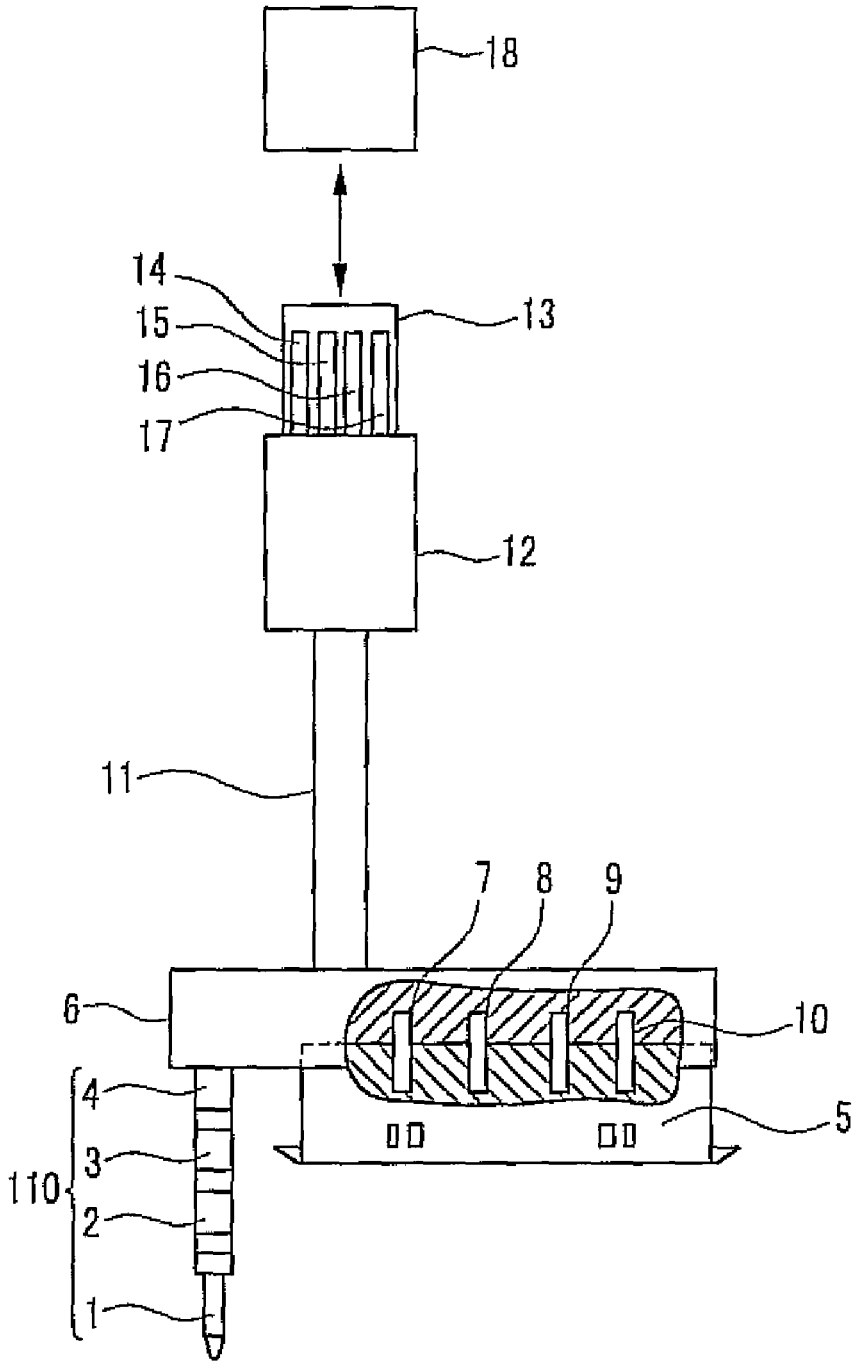
Figure 1C:
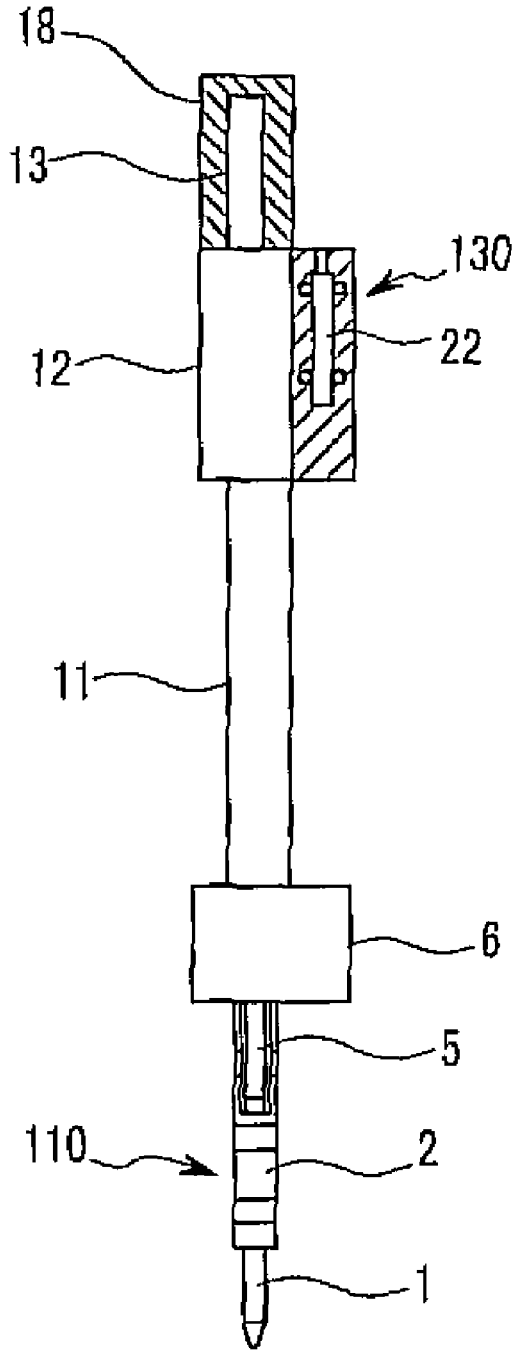
Figure 1D:
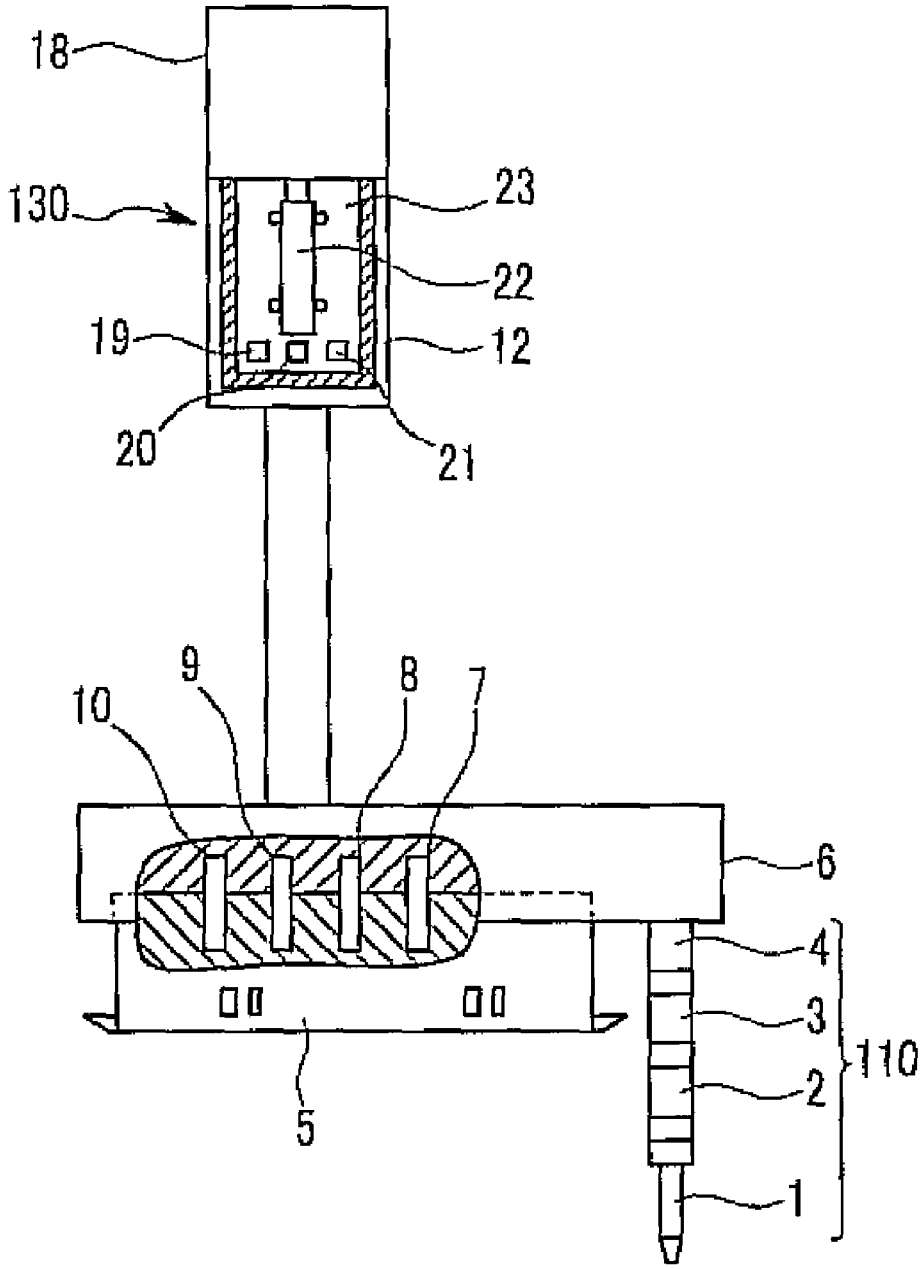

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

FIGS. 1A to 1D are drawings illustrating a configuration of a multifunctional connection cord according to an exemplary embodiment of the present invention.

Referring to FIGS. 1A to 1D, the multifunctional connection cord is provided with a stem 6 and a USB connector 12 connected to the stem 6 through a cable 11. The stem is provided with an audio plug 110 and a data/power connector 5 connected to the stem 6.

The audio plug 110 includes a first contact 1, a second contact 2, a third contact 3, and a fourth contact 4.

The data/power connector 5 includes a positive power pin 7, a positive data pin 8, a negative data pin 9, and a negative power pin 10.

The USB connector 12 is provided with a USB plug 13 including a positive power pin 14, a positive data pin 15, a negative data pin 16, and a negative power pin 17. The first to fourth contacts 1, 2, 3, and 4 of the audio plug 110 are electrically connected to the positive power pin 14, positive data pin 15, negative data pin 16, and negative power pin 17, respectively, through the cable 11. The positive power pin 7, positive data pin 8, negative data pin 9, and negative power pin 10 of the data/power connector 5 are connected to the positive power pin 14, positive data pin 15, negative data pin 16, and negative power pin 17, respectively, through the cable 11.

The USB plug 13 is covered by a cap 18 which is detachable, and the USB connector 12 is provided with a socket holder 130.

In this embodiment, the socket holder 130 is formed on a rear surface of the USB plug 13 so as to not interfere with the operation of the USB plug 13.

The socket holder 130 is provided with an audio socket 22 in which a first contact 19, a second conduct 20, and a third contact 21 are formed. The first to third contacts 19, 20, and 21 on a PCB (Printed Circuit Board) 23 are electrically connected to the corresponding contacts 1, 2, and 3 of the audio plug 110. In more detail, the first contact 1 of the audio plug 110 is of a left-hand channel for stereo signals, the second contact 2 of the audio plug is of a right-hand channel for stereo signals, the third contact 3 of the audio plug is of ground, and the fourth contact 4 of the audio plug is of a dummy load for the earphone socket of a multimedia device. The first to third contacts 1, 2, and 3 of the audio plug 110 are connected to the corresponding first to third contacts 19, 20, and 21 of the audio socket 22 via the cable 11, respectively. Accordingly, the cable 11 is provided with at least 4 wires.

Although the USB connector 12 is configured to integrate the socket holder 130 in this embodiment, the USB connector 12 can be implemented with a detachable socket holder 130.

Figure 2A:
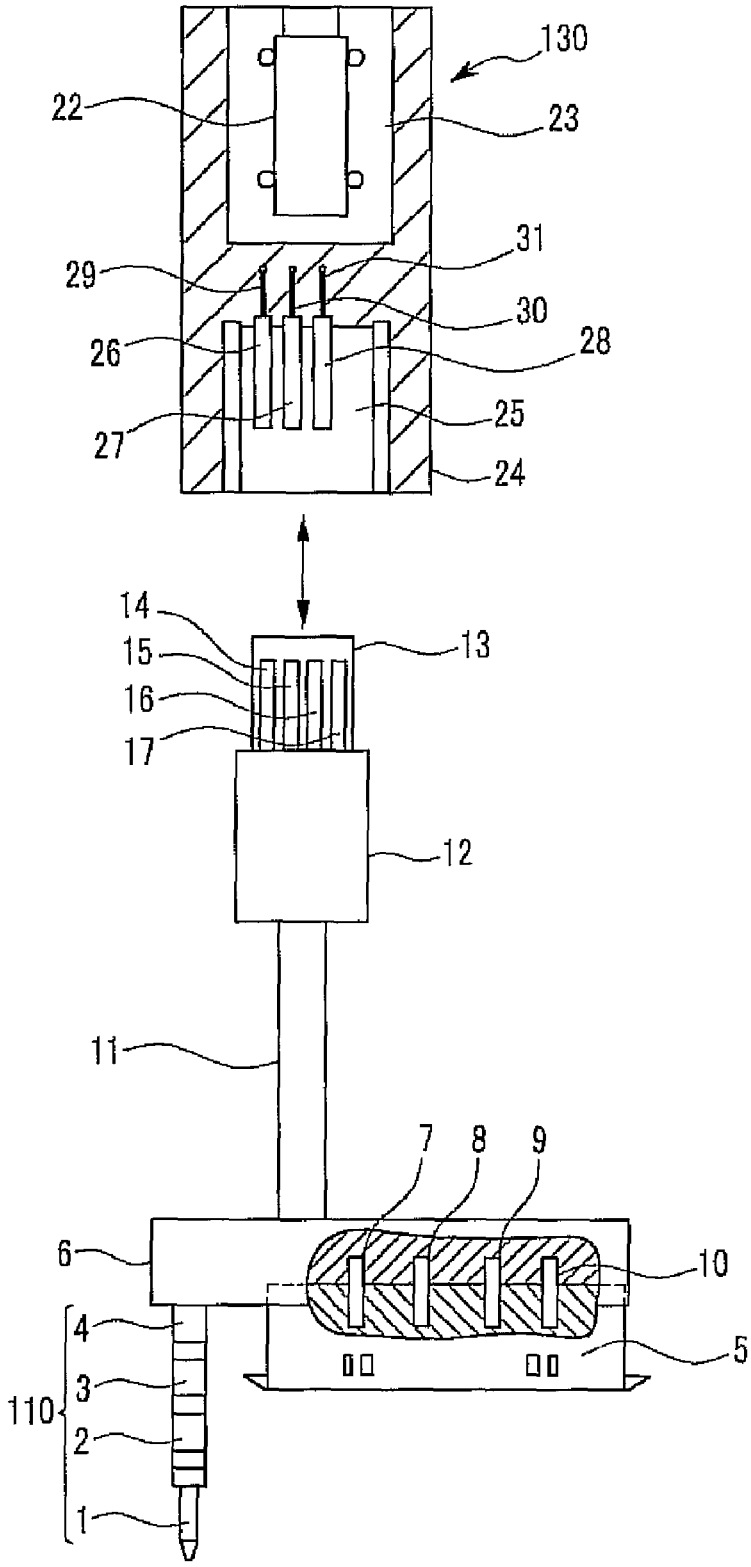
FIGS. 2A and 2B are drawings illustrating a configuration of a multifunctional connection cord according to an exemplary embodiment of the present invention.
Figure 2B:
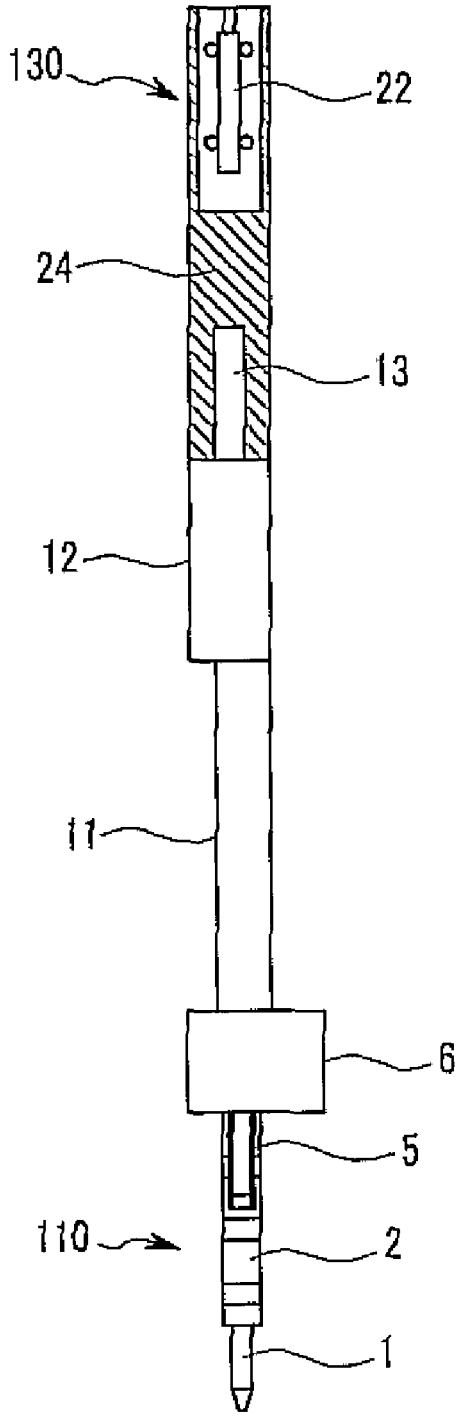

FIGS. 2A and 2B are drawings illustrating a configuration of a multifunctional connection cord according to another exemplary embodiment of the present invention.

In this embodiment, the configuration of the multifunctional connection cord in which the stem 6 having an audio plug 110 and a data/power connector 5 is connected to the USB connector 12 through a cable 11 is identical with the multifunctional connection cord of the embodiment illustrated in FIGS. 1A to 1D. Thus, the same reference numbers are used to refer to the same parts.

The detachable socket holder 130 includes a body 24 having an audio socket 22 formed at one end and a USB socket 25 formed at the other end for receiving the USB plug 13.

The USB socket 25 is provided with a first contact pin 26 corresponding to the negative power pin 14 of the USB plug 13, a second contact pin 27 corresponding to the positive data pin 15 of the USB plug 13, and a third contact pin 28 corresponding to the negative data pin 16 of the USB plug 13. The first to third contact pins 26, 27, and 28 are also electrically connected to corresponding pins of the audio socket 22 through respective wires 29, 30, and 31.

In this configuration, the audio lines are established between the audio plug 110 connected to a multimedia device and the audio socket 22 via a cable 11, USB connector 12, and USB socket 25. A pair of data lines are established between the data/power connector 5 and the USB connector 12.

Figure 3A:
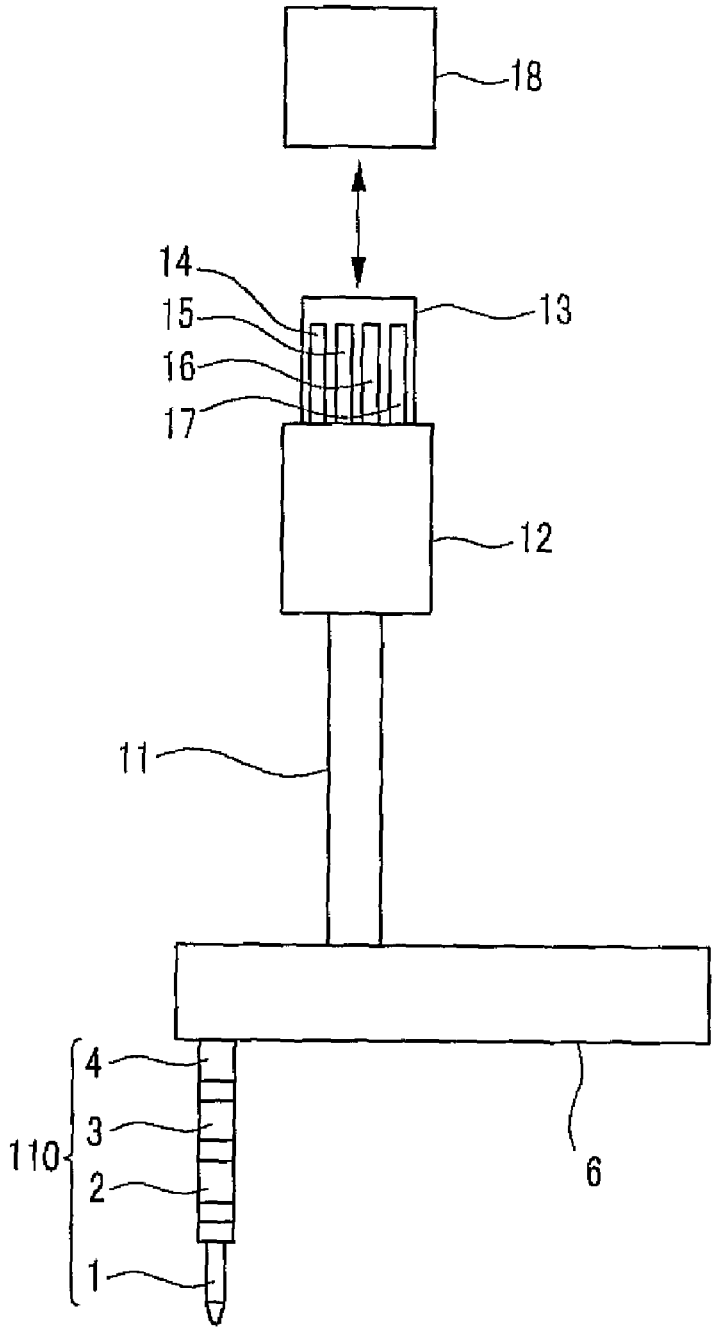
FIGS. 3A to 3C are drawings illustrating a configuration of a multifunctional connection cord according to another exemplary embodiment of the present invention.
Figure 3B:
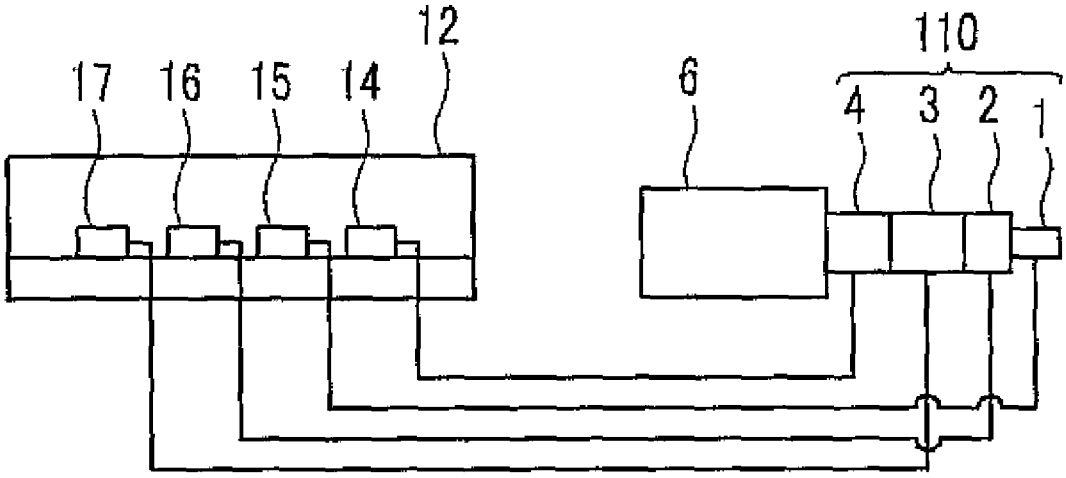
Figure 3C:
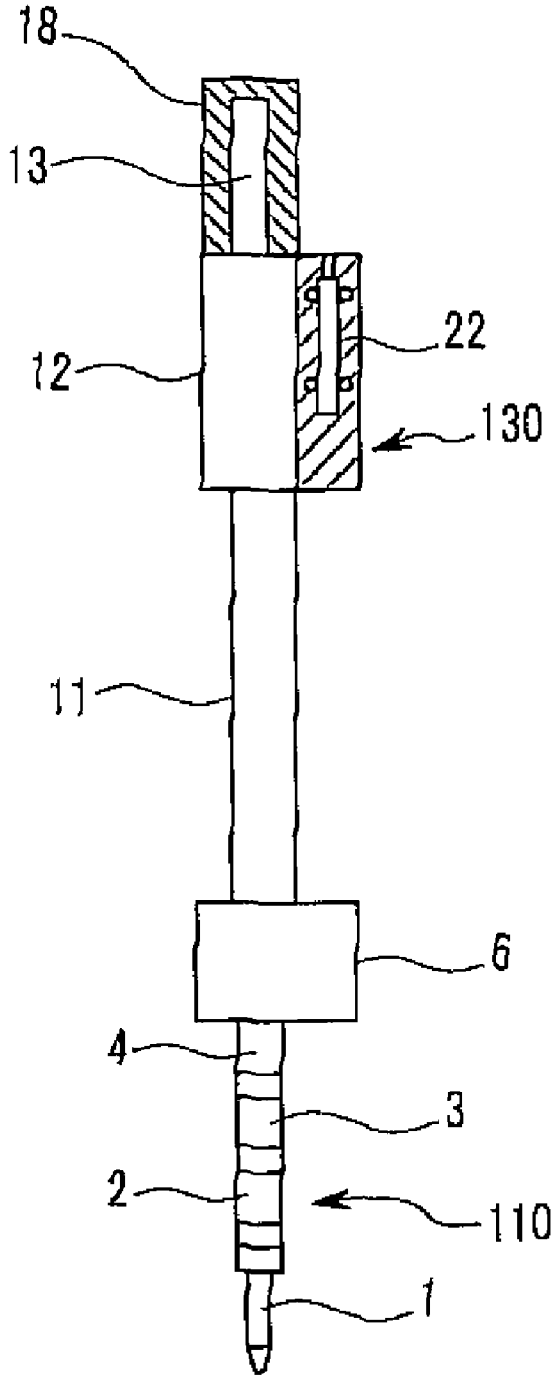

FIGS. 3A to 3C are drawings illustrating a configuration of a multifunctional connection cord according to another exemplary embodiment of the present invention. In this embodiment, the stem is provided with the audio plug 110 but not the data/power connector.

Unlike the embodiments illustrated in FIGS. 1A to 1D and FIGS. 2A and 2B in which the fourth contact 4 is configured as a dummy load, the first to fourth contacts 1 to 4 of the audio plug 110 are connected to the respective positive power pin 14, positive data pin 15, negative data pin 16, and negative power pin 17 of the USB connector 12 so as to establish data input/output lines. The USB connector 12 is also provided with the socket holder 130 having the audio socket 22 such that the first to third contacts 1 to 3 are connected to the corresponding pins of the audio socket 22 to establish a pair of audio lines. The USB plug 13 is covered by the cap 18 when it is not in use.

Figure 4A:
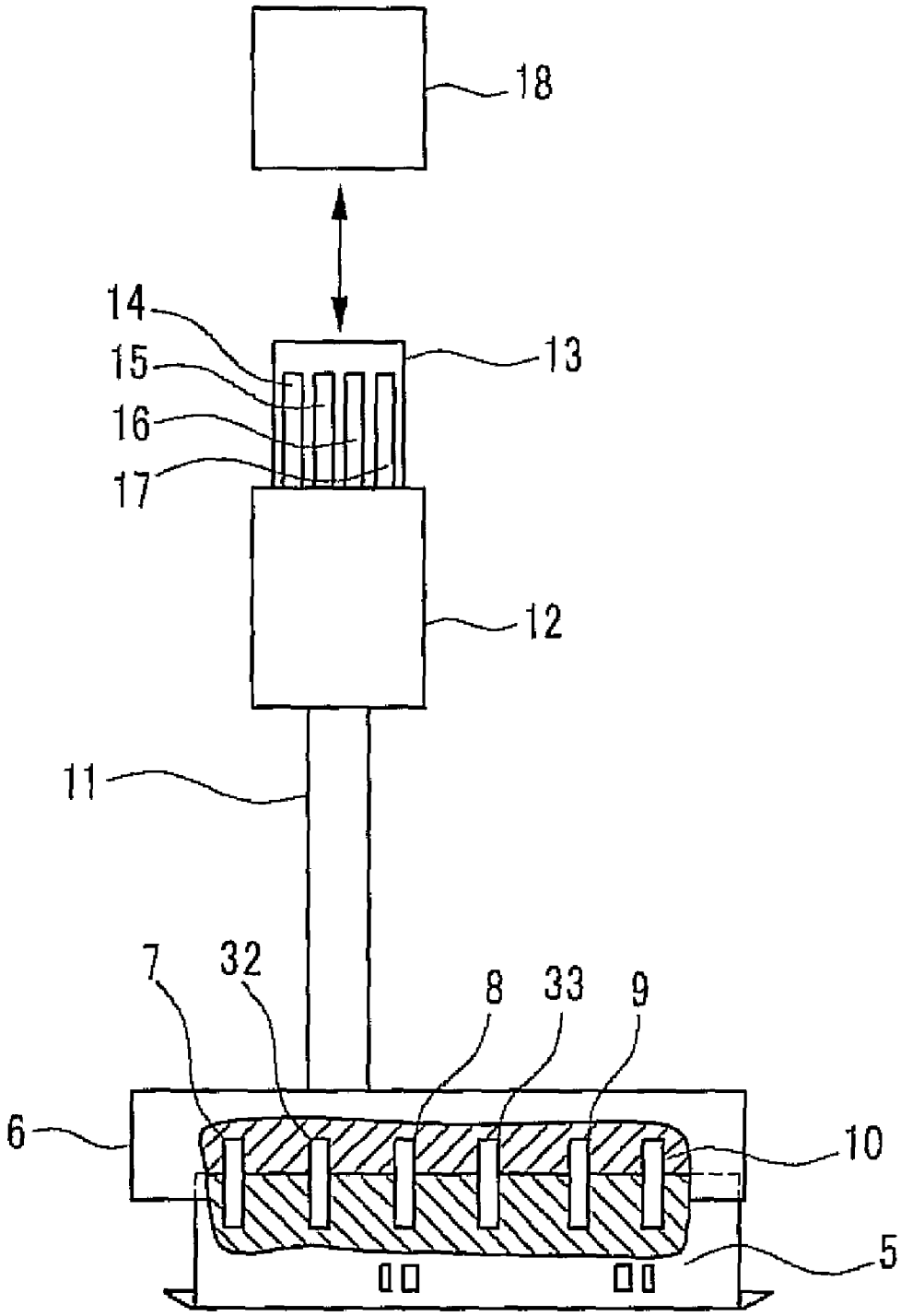
FIGS. 4A and 4B are drawings illustrating a configuration of a multifunctional connection cord according to another exemplary embodiment of the present invention.
Figure 4B:
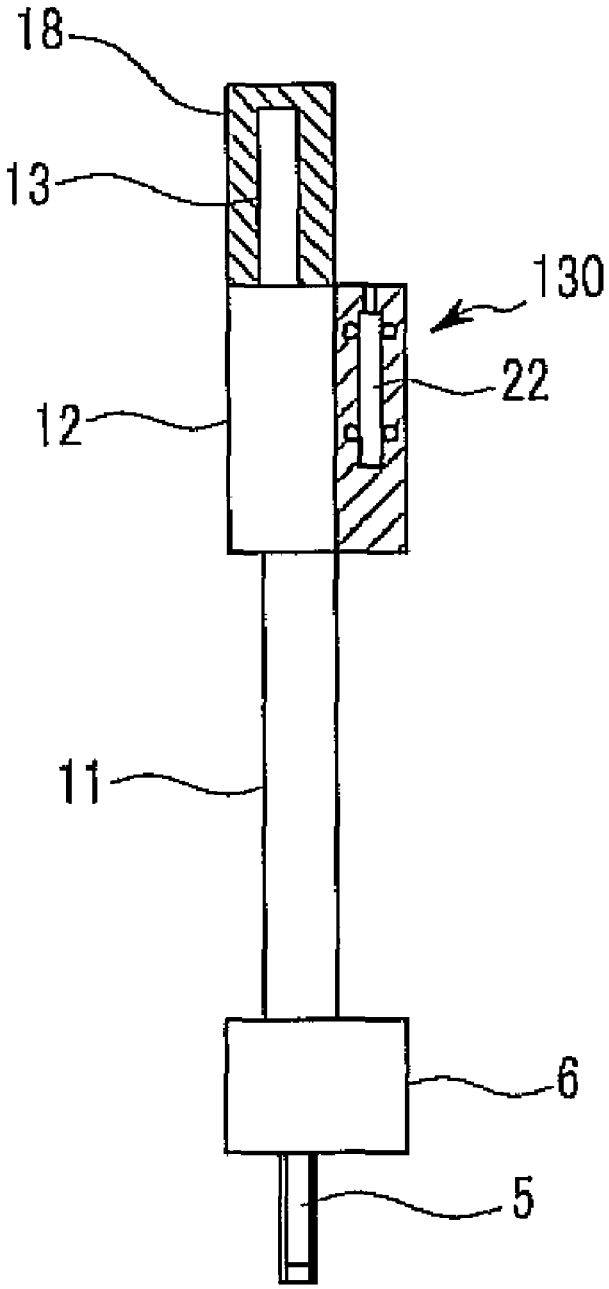

FIGS. 4A and 4B are drawings illustrating a configuration of a multifunctional connection cord according to another exemplary embodiment of the present invention. In this embodiment, the stem 6 is provided with the data/power connector 5 but not the audio plug 110.

In this embodiment, the positive power pin 7, positive data pin 8, negative data pin 9, and negative power pin 10 of the data/power connector are connected to the respective positive power pin 14, positive data pin 15, negative data pin 16 and negative power pin 17 of the USB connector 12 so as to establish the data input/output lines. In addition to the data and power pins 7 to 10, the data/power connector 5 further includes a first audio pin 32 and a second audio pin 33 that are connected to corresponding pins of the audio socket 22 formed in the socket holder 130 so as to establish a pair of audio lines.

With this configuration, the data input/output lines are established between the data/power connector 5 and the USB connector 12, and the audio lines are established between the data/power connector 5 and the audio socket 22. In order to protect the USB plug 13 from damage, a cap is provided for covering the USB plug 13.

How to use the multifunctional connection cord according to an embodiment of the present invention is described with reference to FIG. 5.

Figure 5:
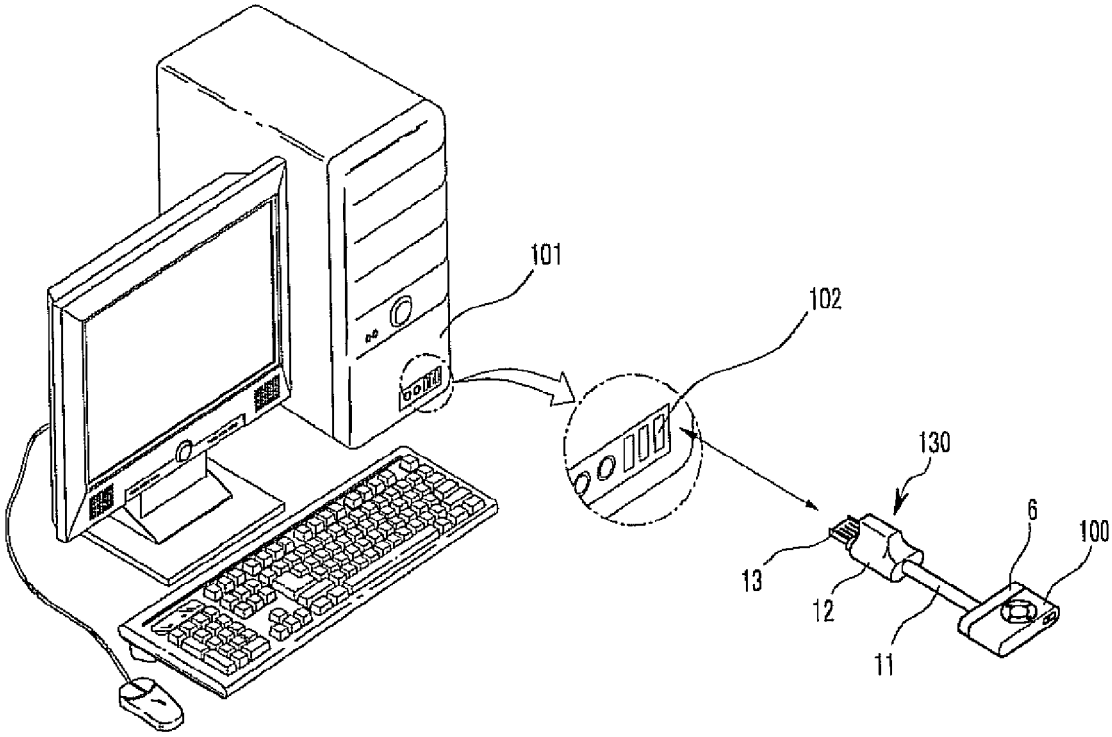
FIG. 5 is a drawing illustrating how to connect a multimedia device to an external device using the multifunctional connection cord according to an exemplary embodiment of the present invention.

FIG. 5 is a drawing illustrating how to connect a multimedia device to an external device using the multifunctional connection cord according to an exemplary embodiment of the present invention.

As shown in FIG. 5, the stem of the multifunctional connection cord is connected to a multimedia device 100 such as an MP3 player by means of at least one of the audio plug 110 and the data/power connector 5, and the USB connector 12 of the multifunctional connection cord is connected to an external device 101 such as PC by inserting the USB plug 13 into a USB socket 102 of the external device 101. The multimedia device 10 can exchange data with the external device 101 and can be charged by the external device 101 through the respective data and power lines established by the multifunctional connection cord.

Figure 6:
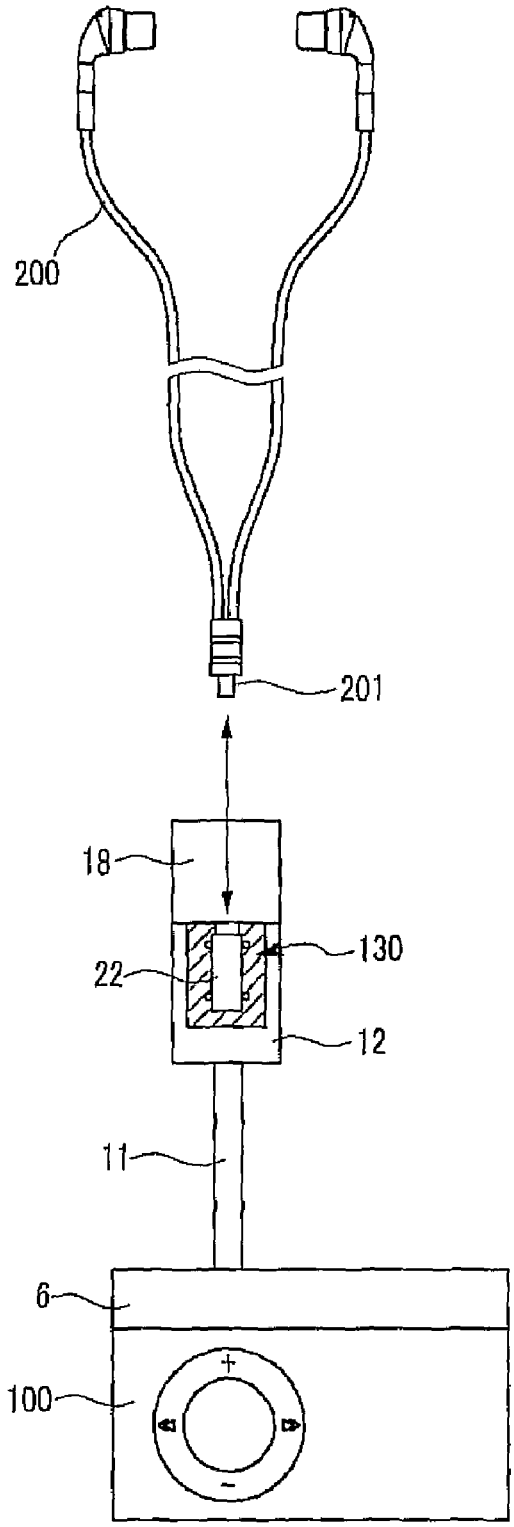
FIG. 6 is a drawing illustrating how to connect an earphone to a multimedia device using a multifunctional connection cord according to another exemplary embodiment of the present invention.

FIG. 6 is a drawing illustrating how to connect an earphone to a multimedia device using a multifunctional connection cord according to an exemplary embodiment of the present invention.

In order to listen to audio sound that is output from the multimedia device 100, an earphone can be connected to the multimedia device through the multifunctional connection cord. In this case, audio lines are established by inserting an audio plug 201 of an earphone 200 into the audio socket 22 provided in the socket holder 130 of the multifunctional connection cord. In order to protect the USB plug 13 from being damaged, it is preferred to cover the USB plug 13 with the cap 18.

Figure 7:
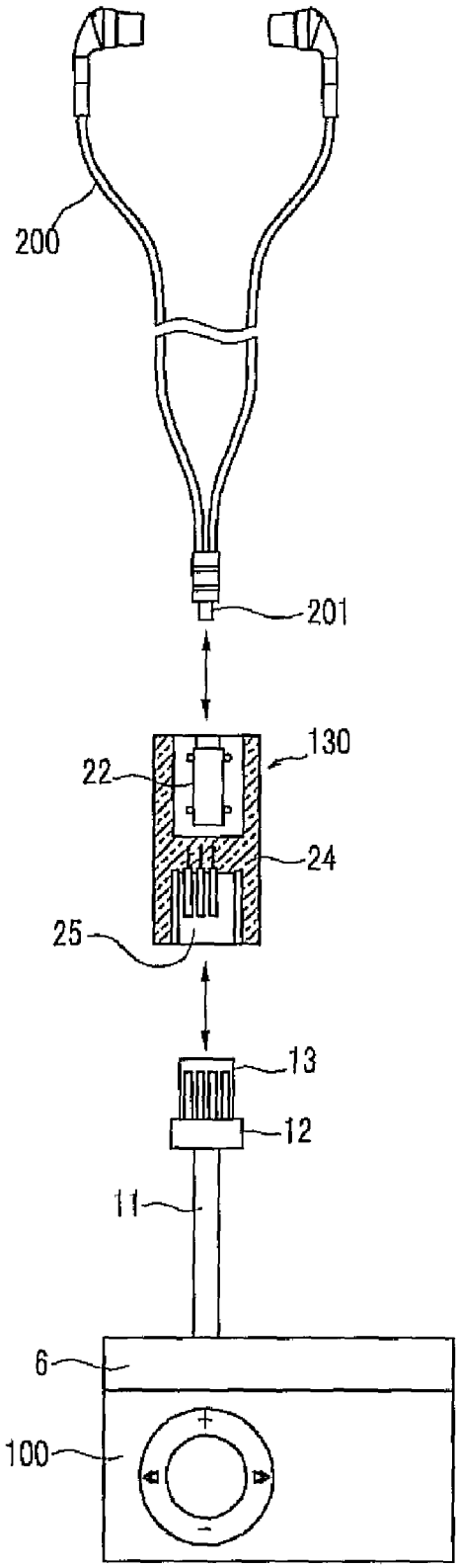
FIG. 7 is a drawing illustrating how to connect an earphone to a multimedia device using a multifunctional connection cord according to another exemplary embodiment of the present invention.

In a case that the multimedia connection cord is implemented with a detachable socket holder 130, the audio lines are established by inserting the audio plug 201 of the earphone 200 into the audio socket 22 of the detachable socket holder 130 and inserting the USB plug 13 into the USB socket 25 of the detachable socket holder 130, as shown in FIG. 7.

Although exemplary embodiments of the present invention are described in detail hereinabove, it should be clearly understood that many variations and/or modifications of the basic inventive concepts herein taught which may appear to those skilled in the present art will still fall within the spirit and scope of the present invention, as defined in the appended claims.

As described above, the multifunctional connection cord according to an embodiment of the present invention includes an audio plug and data/power connector that are installed at one end of a cable for connection to a multimedia device, a USB connector that is installed at the other end of the cable for connection to a PC, and a socket holder having an audio socket piggybacked on the USB connector, whereby the multimedia connection cord allow charging the multimedia device and exchanging data with the PC as well as an audio connection to an earphone.

In the multifunctional connection cord according to an embodiment of the present invention, the audio plug is electrically connected to the audio socket such that it is possible to output audio signals from the multimedia device to the earphone by inserting an audio plug of the earphone into the audio socket. The multimedia device can exchange data with the PC through the data lines established the data/power connector and the USB connector.

Also, the USB connector of the multifunctional connection cord according to an embodiment of the present invention is provided with a cap for covering a USB plug, thereby protecting the USB plug from being damaged when it is not in use.

The multifunctional connection cord according to an embodiment of the present invention includes an audio plug and a data/power connector installed at one end of a cable so as to connect the multifunctional connection cord to a connection to a multimedia device, and a USB connector installed at the other end of the cable so as to connect the multimedia device to a PC through data and power lines established between the data/power connector and the USB connector. Also, the multifunctional connection cord is provided with a detachable socket holder having an audio socket connected to the USB connector for coupling an earphone to the multimedia device.

The multifunctional connection cord according to an embodiment of the present invention allows outputting the audio signals of the multimedia device to the earphone through audio lines established between the USB socket and the audio socket.

The multifunctional connection cord according to an embodiment of the present invention allows outputting the audio signal of the multimedia device through the audio plug, USB connector, and the audio socket of the detachable socket holder, and exchanging data with the PC and charging power from the PC through data and power lines established between the USB connector and the data/power connector.

The multifunctional connection cord according to an embodiment of the present invention can be connected to the multimedia device by means of the audio plug and the PC by means of the USB connector so as to allow the multimedia device to be charged by the PC and exchange data with the PC. Also, the audio socket of the socket holder allows connection of an earphone to the multimedia device.

The multifunctional connection cord according to an embodiment of the present invention allows outputting of the audio signals of the multimedia device to an earphone through the audio lines established between the audio plug and the USB connector, and allows selective charging of the multimedia device by the PC and exchange of data with the PC.

The multifunctional connection cord according to an embodiment of the present invention is provided with a cap for covering the USB plug of the USB connector so as to protect the USB plug from being damaged when it is not in use.

The multifunctional connection cord according to an embodiment of the present invention is configured to be connected with a multimedia device by means of a data/power connector formed at one end of a cable, with a PC by means of the USB connector formed at the other end of the cable, and with an earphone by means of an audio socket formed on the USB connector, thereby charging the multimedia device through power lines established between the data/power connector and the USB connector, enabling exchange of data between the multimedia device and the PC through data lines established between the data/power connector and the USB connector, and output of audio signals to the earphone through audio lines established between the audio socket of the socket holder and the audio plug of the stem.

The multifunctional connection cord according to an embodiment of the present invention allows selective charging of the multimedia device, exchange of data between the multimedia device and the PC, and output of audio signals to the earphone with only the configuration of wires interconnecting the data/power connection and the USB connector.

The multifunctional connection cord according to an embodiment of the present invention is provided with a cap for covering the USB plug when it is not in use, so as to protect the USB plug from being damaged.

The multifunctional connection cord according to an embodiment of the present invention is configured to establish data and power lines between a multimedia device and a PC and audio lines between the multimedia device and earphones having various types of audio plugs, thereby improving user convenience and audio output compatibility.

Unlike the conventional connection mechanism in which a USB cable and an earphone should be changeably connected to the portable device for their respective purposes, particularly with a portable device having a single multifunctional connection port having USB pins and audio pins, the multifunctional connection cord enables connecting the earphone and another external device to the portable device through the respective USB and audio outlets branched out from a single inlet, resulting in improvement of user's convenience.

The multifunctional connection cord of the present invention can be constantly connected to the connection port of a portable device as an aesthetic accessory, thereby preventing the high-price portable device from being damaged by repeated attachment/detachment of other devices while maintaining multipurpose connection functionalities.

The multifunctional connection cord of the present invention is advantageous in terms of improving connection convenience and protection of a portable device without breaking the design concept of the portable device.

What is claimed is:

1. A multifunctional connection cord for multimedia devices comprising:

a stem;

an audio plug mounted to protrude from one side of the stem for establishing audio signal lines with a multimedia device, wherein the audio plug includes a plurality of contact terminals;

a data/power connector mounted near the audio plug to protrude from the stem for establishing data lines and power charge lines with an external device, wherein the data/power connector includes a plurality of contact terminals;

a USB connector electrically connected to the audio plug and the data/power connector through a cable via the stem, wherein the USB connector includes a plurality of contact terminals; and a socket holder integrally mounted on one side of the USB connector and having an audio socket for receiving an audio plug, wherein the socket holder includes a plurality of contact terminals;

wherein (a) a first portion of the audio plug contact terminals are electrically connected to the socket holder contact terminals, and (b) a second portion of the audio plug contact terminals are not electrically connected to the socket holder contact terminals;

wherein each of the USB connector contact terminals are connected to both (a) one of the plurality of audio plug contact terminals and (b) one of the plurality of data/power contact terminals; and wherein there is no electrical connection between the USB connector contact terminals and the socket holder contact terminals that does not pass through the cable.

2. The multifunctional connection cord of claim 1, wherein the audio plug contact terminals comprise three contact terminals that are electrically connected to corresponding socket holder contact terminals of the audio socket for establishing audio lines and a single contact terminal that is not electrically connected to any of the socket holder contact terminals; and the data/power connector contact terminals comprise a positive power pin, a positive data pin, a negative data pin, and a negative power pin that are electrically connected to a corresponding positive power pin, positive data pin, negative data pin, and negative power pin of the USB connector.

3. The multifunctional connection cord of claim 1, wherein the USB connector further comprises a detachable cap.

4. A multifunctional connection cord for multimedia devices comprising:

a stem;

an audio plug mounted to protrude from one side of the stem for establishing audio signal lines with a multimedia device, wherein the audio plug has a plurality of contact terminals;

a data/power connector mounted near the audio plug to protrude from the stem for establishing data lines and power charge lines with an external device, wherein the data/power connector includes a plurality of contact terminals;

a USB connector electrically connected to the audio plug and the data/power connector through a cable having a plurality of electrical conductors that are insulated from each other, wherein the USB connector includes a plurality of contact terminals; and a detachable socket holder having (a) a USB socket formed at one end for electrically connecting the detachable socket holder to the USB connector and (b) an audio socket formed at the other end for receiving an audio plug, wherein the USB socket includes a plurality of contact terminals, the audio socket includes a plurality of contact terminals, and at least one of the USB socket contact terminals is not electrically connected to any of the audio socket contact terminals;

wherein each of the USB connector contact terminals are connected to both (a) one of the plurality of audio plug contact terminals and (b) one of the plurality of data/power contact terminals; and wherein (a) a first portion of the audio plug contact terminals are electrically connected to the socket holder contact terminals, and (b) a second portion of the audio plug contact terminals are not electrically connected to the socket holder contact terminals.

5. The multifunctional connection cord of claim 4, wherein the USB socket comprises three contact terminals that are connected to corresponding contact terminals of the audio socket through respective wires.

6. A multifunctional connection cord for multimedia devices comprising:

a stem;

an audio plug mounted to protrude from one side of the stem for establishing audio signal lines with a multimedia device, wherein the audio plug includes a plurality of contact terminals;

a USB connector electrically connected to the audio plug through a cable having a plurality of electrical conductors that are insulated from each other, wherein the USB connector includes a plurality of contact terminals; and a socket holder integrally mounted on one side of the USB connector and having an audio socket for receiving an audio plug, wherein the socket holder includes a plurality of contact terminals;

wherein (a) a first portion of the audio plug contact terminals are electrically connected to the socket holder contact terminals, and (b) a second portion of the audio plug contact terminals are not electrically connected to the socket holder contact terminals;

wherein each of the USB connector contact terminals are connected to one of the plurality of audio plug contact terminals; and wherein there is no electrical connection between the USB connector contact terminals and the socket holder contact terminals that does not pass through the cable.

7. The multifunctional connection cord of claim 6, wherein the audio plug contact terminals comprise three contact terminals that are electrically connected to corresponding socket holder contact terminals and a single contact terminal that is not electrically connected to any of the socket holder contact terminals.

8. The multifunctional connection cord of claim 6 wherein the USB connector further comprises a detachable cap.

9. A multifunctional connection cord for multimedia devices comprising:

a stem;

a data/power connector mounted to protrude from one side of the stem for establishing data lines and power charge lines with an external device via a dock, wherein the data/power connector includes a plurality of contact terminals;

a USB connector electrically connected to the data/power connector through a cable having a plurality of electrical conductors that are insulated from each other, wherein the USB connector includes a plurality of contact terminals; and a socket holder integrally mounted on one side of the USB connector and having an audio socket for receiving an audio plug, wherein the socket holder includes a plurality of contact terminals;

wherein (a) a first portion of the data/power connector contact terminals are electrically connected to at least one of the USB connector contact terminals, and (b) a second portion of the data/power connector contact terminals are electrically connected to at least one of the audio socket contact terminals; and wherein there is no electrical connection between the USB connector contact terminals and the socket holder contact terminals that does not pass through the cable.

10. The multifunctional connection cord of claim 9, wherein the data/power connector comprises a negative power pin, a positive data pin, a negative data pin, and a positive power pin that are electrically connected to a negative power pin, a positive data pin, a negative data pin, and positive power pin of the USB connector.

11. The multifunctional connection cord of claim 9, wherein the USB connector further comprises a detachable cap.

12. A cord comprising:

a first end that has, formed into a first housing, (a) a male audio port with at least four contacts and (b) a first connector with at least four contacts;

a second end that is opposite the first end and that has, formed into a second housing, (a) a female audio port with at least three contacts and (b) a second connector with at least four contacts;

a first conductor that electrically connects a first contact of the male audio port with a first contact of the second connector;

a second conductor that electrically connects a second contact of the male audio port with a second contact of the second connector;

a third conductor that electrically connects a third contact of the male audio port with a third contact of the second connector;

a fourth conductor that electrically connects a fourth contact of the male audio port with a fourth contact of the second connector;

a fifth conductor that electrically connects a first contact of the first connector with the first contact of the second connector;

a sixth conductor that electrically connects a second contact of the first connector with the second contact of the second connector;

a seventh conductor that electrically connects a third contact of the first connector with the third contact of the second connector;

an eighth conductor that electrically connects a fourth contact of the first connector with the fourth contact of the second connector;

a ninth conductor that electrically connects a first contact of the female audio port with the first contact of the male audio port;

a tenth conductor that electrically connects a second contact of the female audio port with the second contact of the male audio port; and an eleventh conductor that electrically connects a third contact of the female audio port with the third contact of the male audio port.

* * * * *